US005102346A

United States Patent [19]

Soes

[11] Patent Number: 5,102,346

[45] Date of Patent: Apr. 7, 1992

[54] ZERO INSERTION FORCE CONNECTOR FOR CABLE-TO-BOARD APPLICATIONS

[75] Inventor: Lucas Soes, Rosmalen, Netherlands

[73] Assignee: AMP Incorporated, Harrisburg, Pa.

[21] Appl. No.: 749,464

[22] Filed: Aug. 14, 1991

Related U.S. Application Data

[63] Continuation of Ser. No. 584,822, Sep. 19, 1990, abandoned.

[30] Foreign Application Priority Data

Sep. 25, 1989 [GB] United Kingdom ..... 8921633

[51] Int. Cl.[5] ..... H01R 13/635

[52] U.S. Cl. ..... 439/268; 439/264; 439/331

[58] Field of Search ..... 439/259-268, 439/330, 331, 152

[56] References Cited

U.S. PATENT DOCUMENTS 2,992,401 7/1961 Lewis ..... 439/268 X
4,332,431 6/1982 Bobb et al. ..... 439/267
4,540,228 9/1985 Steele ..... 439/267
4,630,875 12/1986 Korsunsky et al. ..... 439/264
4,872,850 10/1989 Mogi et al. ..... 439/266 X

FOREIGN PATENT DOCUMENTS 0196692 2/1986 European Pat. Off. .
0263296 6/1989 European Pat. Off. ..... 439/267
0385314 2/1990 European Pat. Off. .
8906447 7/1989 PCT Int'l Appl. .

*Primary Examiner*—Larry I. Schwartz
*Assistant Examiner*—Julie R. Daulton
*Attorney, Agent, or Firm*—Eric J. Groen

[57] ABSTRACT

An electrical connector (2) is disclosed which includes an insulating housing (4) which includes a plurality of electrical terminals (100). The connector (2) also includes an actuator (50) which is moveable relative to the housing (4) to open the contact portion (128) for a zero insertion force entry of a stripped conductor of a multiple conductor cable (150). When the actuator is moved vertically downwards, the actuator bottom edge (61) engages an actuator arm (122) which allows the contacts to open and accept the conductor (152).

16 Claims, 6 Drawing Sheets

ZERO INSERTION FORCE CONNECTOR FOR CABLE-TO-BOARD APPLICATIONS

This application is a continuation of application Ser. No. 07/584,822 filed Sept. 19, 1990, now abandoned.

FIELD OF THE INVENTION

This invention relates to an electrical connector for the interconnection of individual conductors of an electrical cable to a printed circuit board.

DESCRIPTION OF THE PRIOR ART

Electrical connectors exist in the electronics industry having the capability of interconnecting individual conductors of a multi-conductor flat cable to circuit traces of printed circuit boards. These connectors are mounted to the board having electrical terminals exposed at a lower edge thereof which make electrical contact with the traces on the printed circuit board. The electrical connectors also have electrical terminals which accept the conductors in an electrically conducting manner.

One electrical connector in particular, includes an electrical terminal housing having through passageways for electrical terminals. The housing has a lower face which mounts proximate to the printed circuit board and an upper face which accepts the multi-conductor cable. The terminals are placed in respective passageways within the connector housing, with printed circuit board posts extending beyond the lower face, and cable receiving portions of the terminals disposed proximate to the upper face. The housing also includes a camming member which is moveable to open the cable receiving portion of the terminal, to accept the wire in a zero insertion force fashion. Release of the camming member returns the spring to an undeflected position and into contact with the wire.

A disadvantage of the above mentioned connector is that the upper face, which includes the conductor receiving openings, is an integral part of the moveable camming member. Thus, to make the electrical connection, the cable is stripped to expose the conductors, and the cam is actuated to open the conductor receiving portions of the terminals. The actuation of the camming member also moves the upper face and the conductor receiving openings, as the conductor receiving openings are integral with the camming member. When the conductors are inserted within the openings, and the camming member released, the spring force actually forces the camming member, including the upper face and openings, upwardly which drives the cable and conductors upwardly also. This reverse spring force could take the conductors out of contact with the terminals when the upper face is moved.

SUMMARY OF THE INVENTION

In the present invention, the above mentioned shortcomings have been overcome by designing an electrical connector including an insulating housing having a first conductor receiving face with at least one opening profiled for the receipt of a first conductor, the opening being in communication with a terminal receiving cavity, the terminal receiving cavity having at its upper location, surfaces which are sloped outwardly at lease one electrical terminal disposed in the terminal receiving cavity, the terminal having two contact arms extending upwardly from a base section, the base section being spring loaded upwardly under the influence of a spring means, the spring means causing the two contact arms to be in engagement with the sloped surfaces, spring biased the base section being moveable relative to the terminal receiving cavity, from an upward wire engagement position, to a lower wire receiving position.

In the preferred embodiment of the invention, the connector further comprises an actuator which is operatively connector to the terminal which when actuated moves the terminal from the first to the second position.

In the preferred embodiment of the invention, the connector terminals comprise an outwardly projecting actuator arm which extends from the base section.

In the preferred embodiment of the invention, the actuator comprises a plate section disposed above the actuator arm, whereby movement of the actuator causes a contact between the actuator and the actuator arm thereby causing movement of the terminal from the first to the second position.

With reference now to the drawings, the invention will be described in detail where:

BRIEF DESCRIPTION OF THE DRAWINGS

FIG. 3 is a rear plan view of the electrical connector of the instant invention;

DETAILED DESCRIPTION OF THE PREFERRED EMBODIMENT

Figure 1:
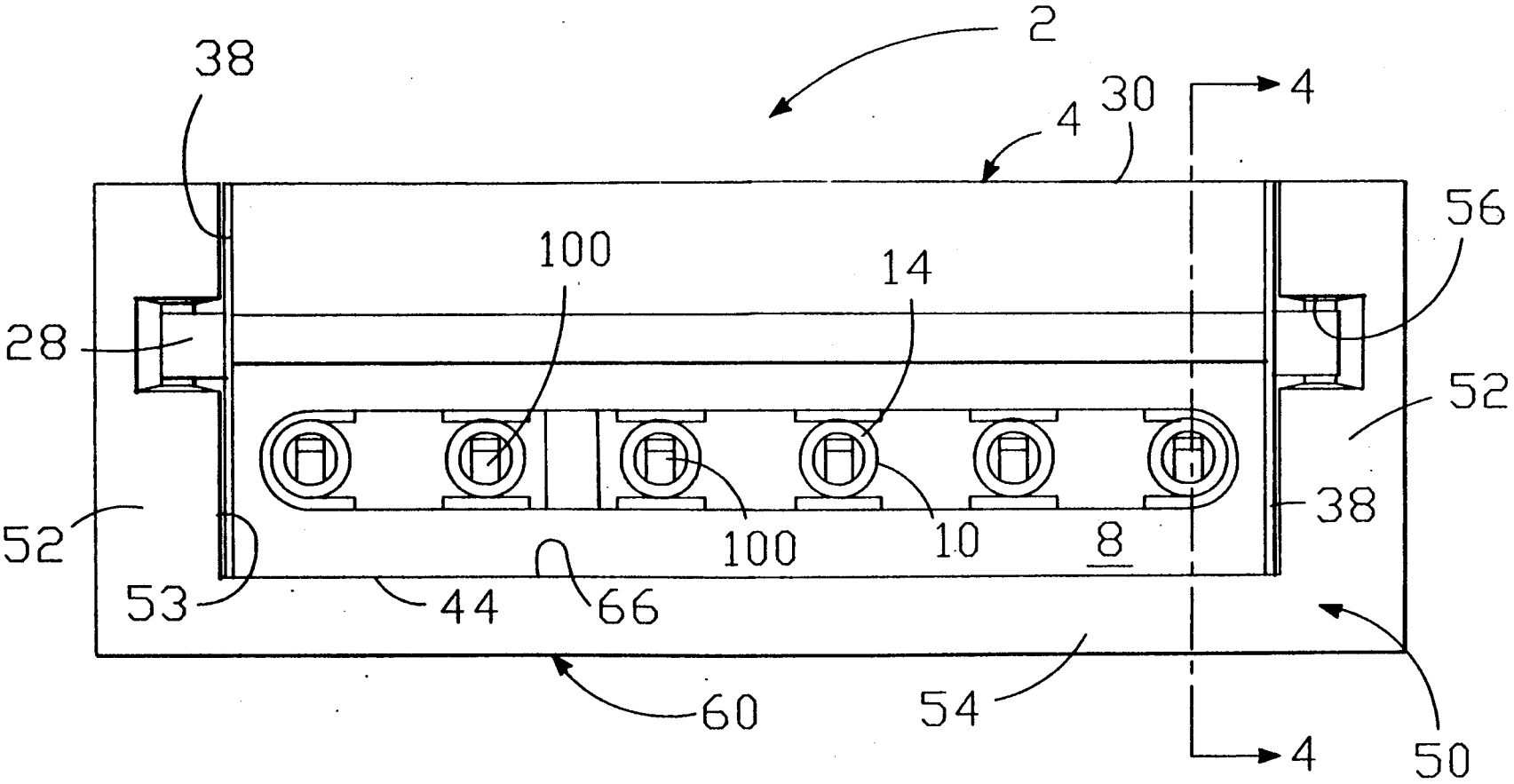
FIG. 1 is a top plan view of the electrical connector of the instant invention.
Figure 2:
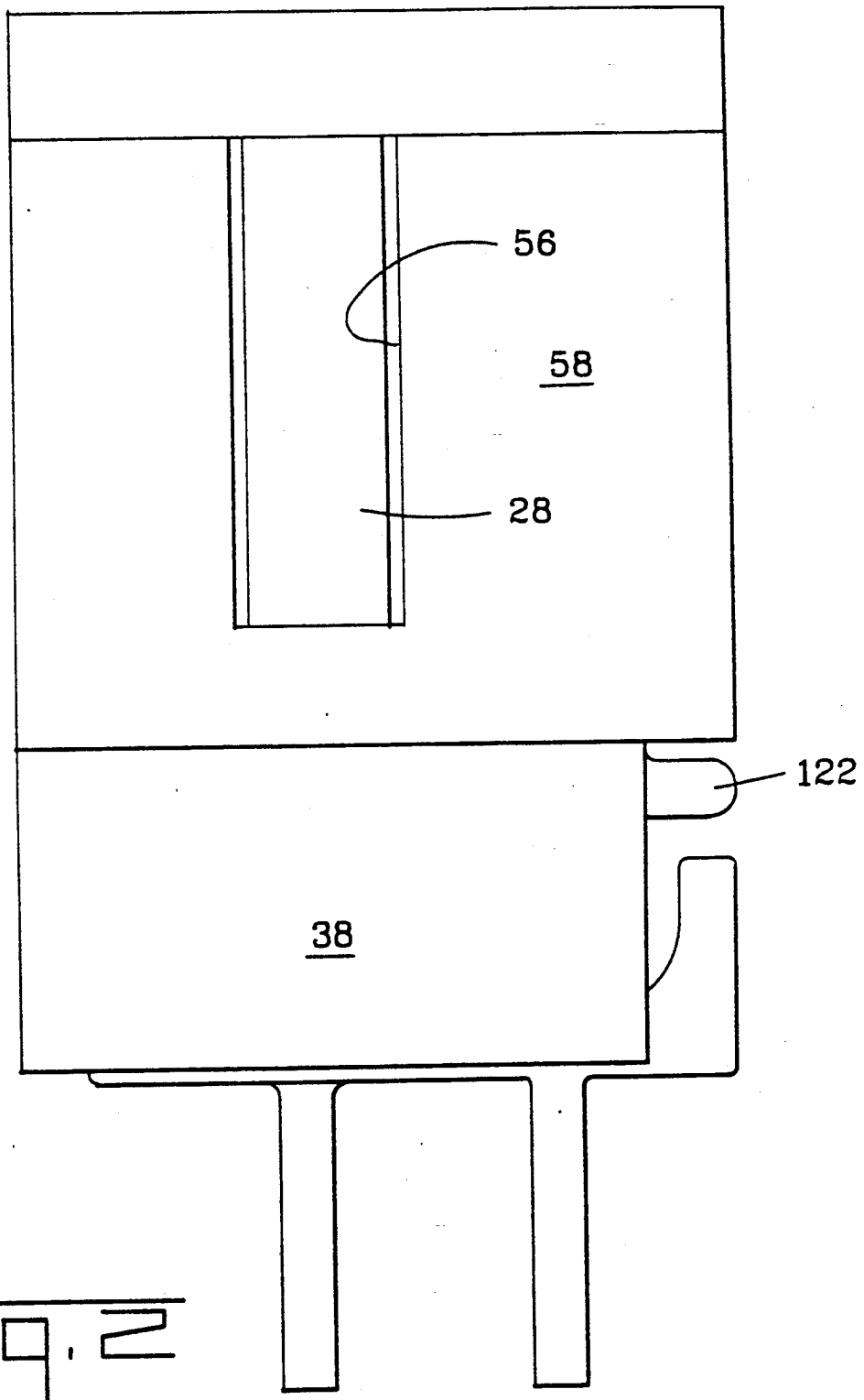
FIG. 2 is a side plan view of the electrical connector shown in FIG. 1.
Figure 7:
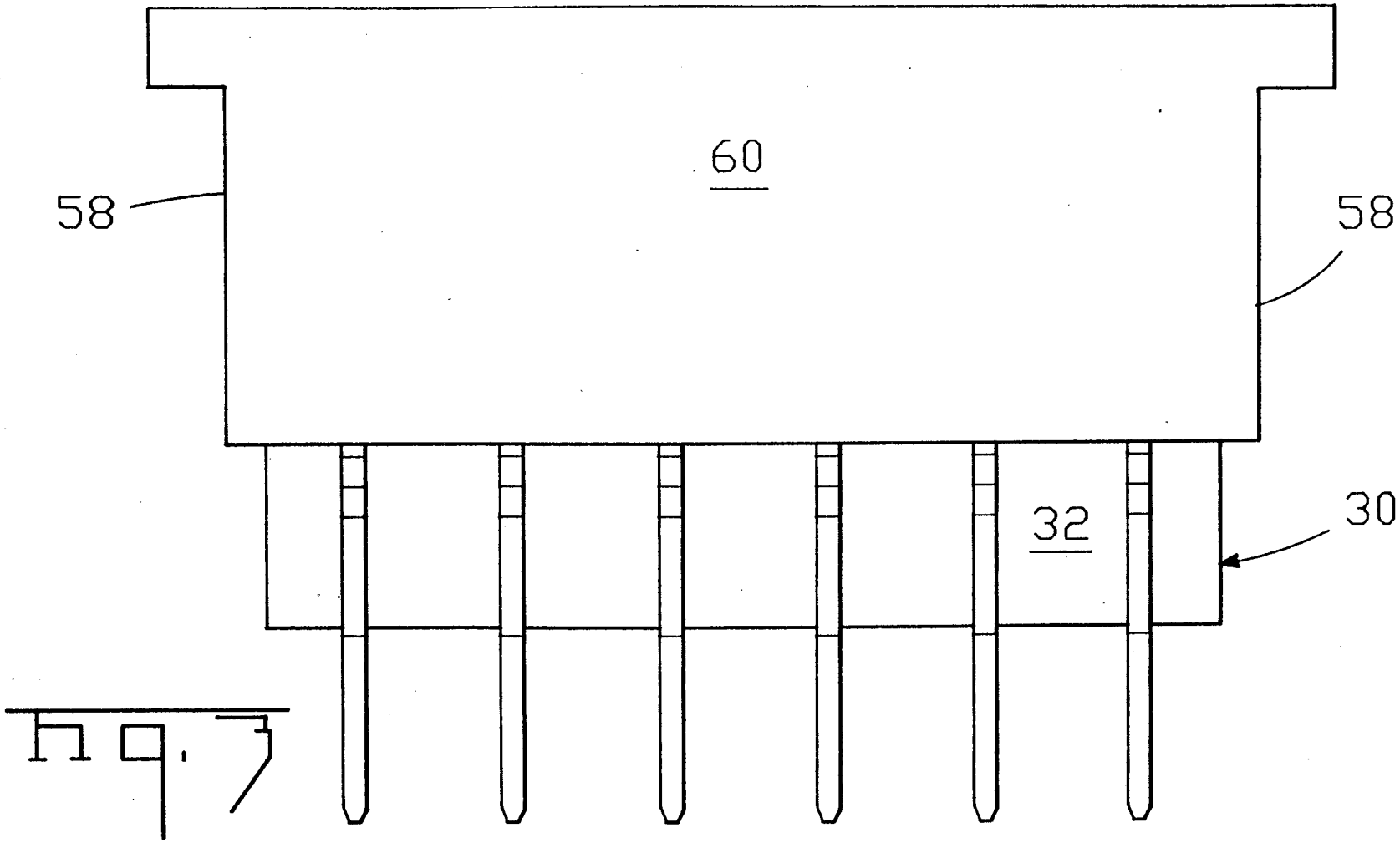

With reference first to FIG. 1, the electrical connector includes a housing of insulating material, shown generally as 4, an actuator member shown as 50, and a plurality of electrical terminals 100, which are insulatively placed within the housing 4. The electrical terminals 100 are juxtaposed for receipt of a plurality of stripped electrical conductors of a flat insulated cable. While the preferred embodiment of the invention relates to an electrical connector for the interconnection of conductors of a flat cable to traces of a printed circuit board, the invention is also suitable for use with a circuit card, or with flexible film having electrical conductors disposed thereon. .

With reference still to FIG. 1, the housing 4 of the invention includes a front wall 30, two sidewalls 38, and a front wall section 44. From the sidewalls 38, project two guiding ribs 28 which extend vertically down the sidewalls. The housing 4 further includes an upper wire receiving face 8, having a plurality of wire receiving apertures 10.

Figure 4:
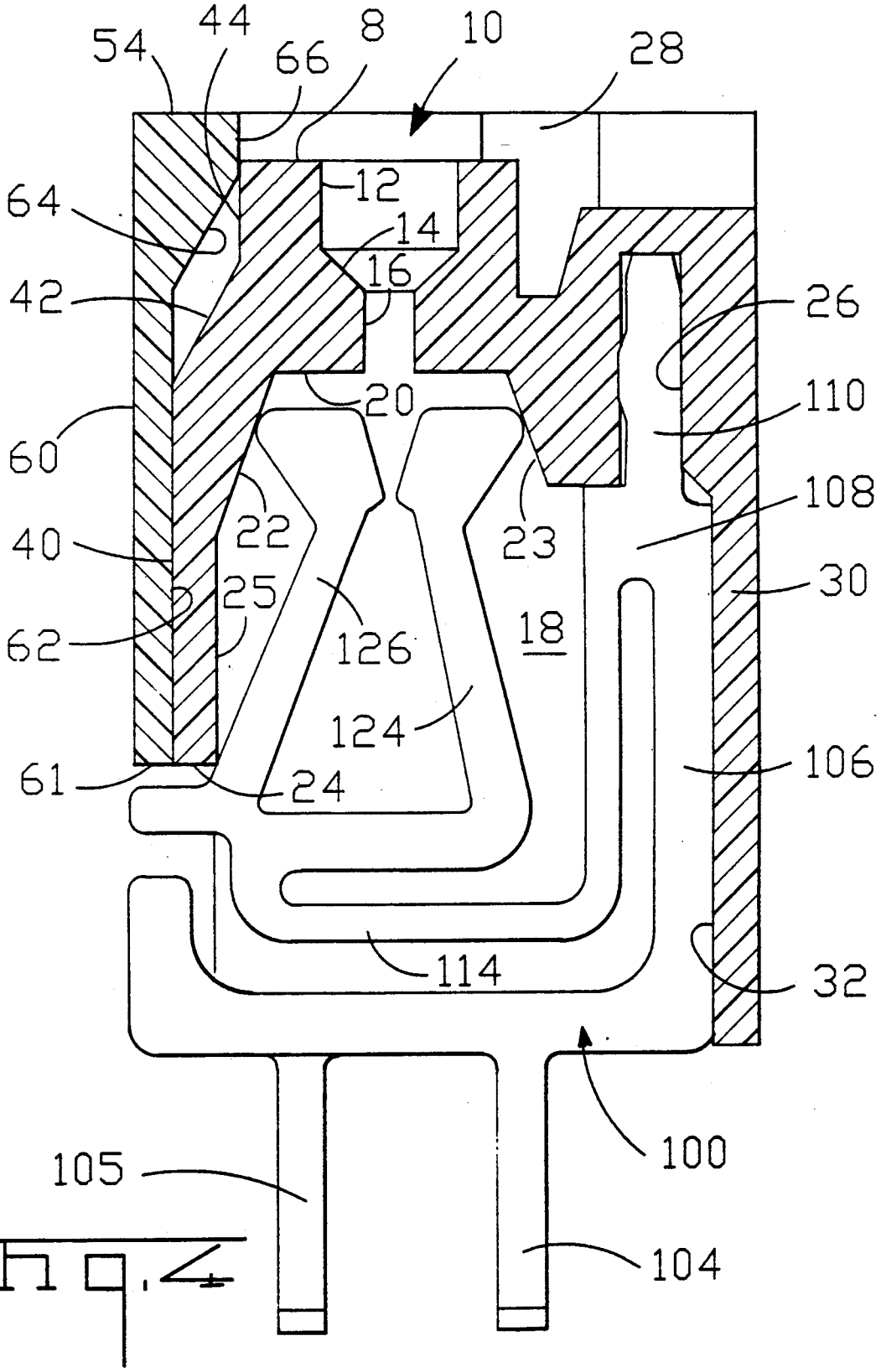
FIG. 4 is a cross-sectional view through the lines 4—4 of FIG. 1.
Figure 5:
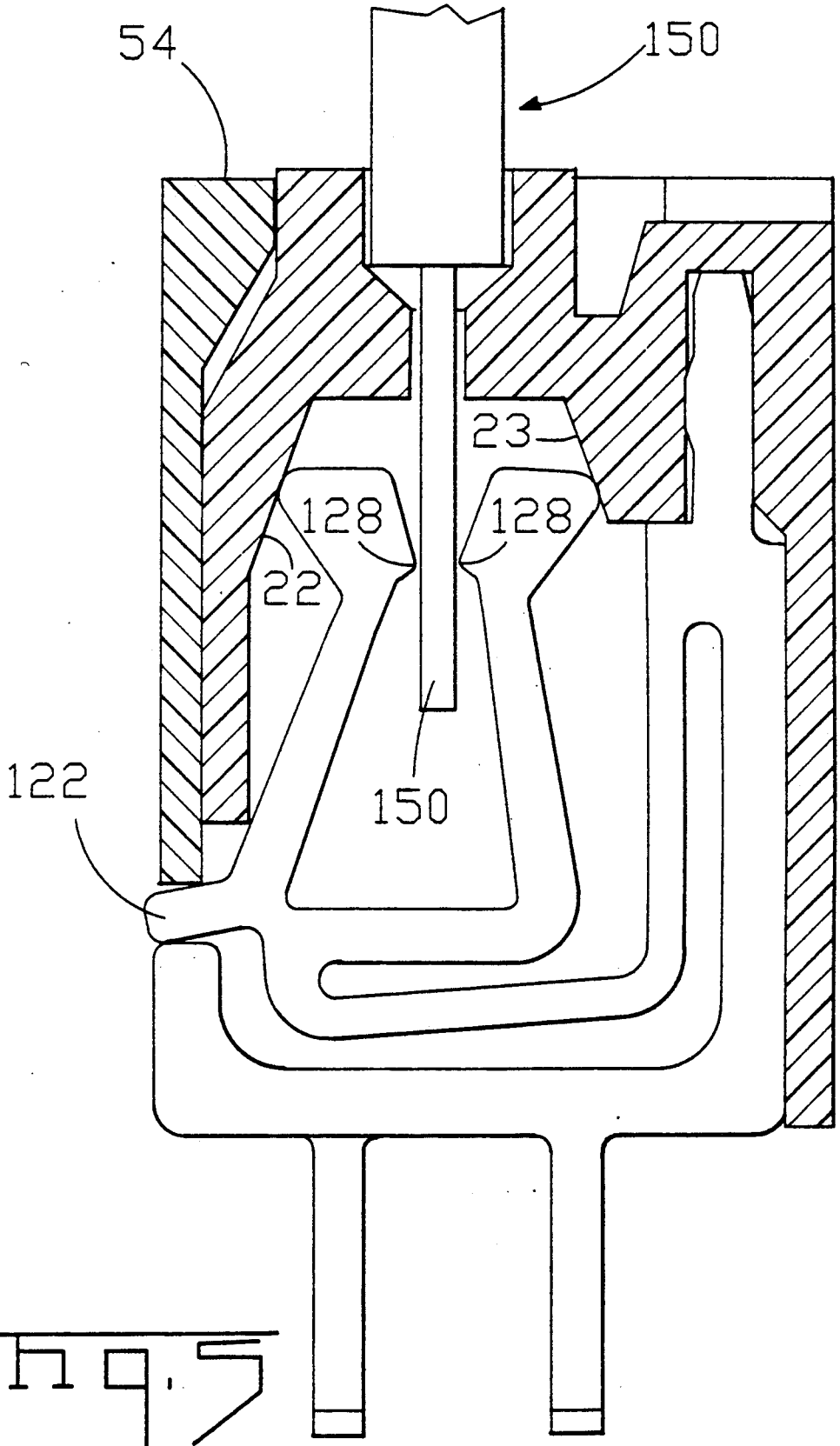
FIG. 5 is a cross-sectional view similar to FIG. 4, showing the connector actuator in the actuated position with the conductor in disposition within the connector.

With reference now to FIG. 4, which is a cross-sectional view along lines 4—4 of FIG. 1 shows the internal structure of the terminal cavities with greater detail. The wire receiving apertures 10 extend downwardly from the wire receiving face 8, and include a first wide bore 12, followed by a tapered section 14, which funnels into a narrow bore 16. The bore 16 then opens into a terminal receiving cavity 18, which includes an upper surface 20, ramped surfaces 22 and 23, and an inner surface 25. Towards the rearward side of the housing 4, each terminal cavity 10 further includes an aperture 26, designed to retain the terminals 100 in place. The outer surface of the connector housing is defined by a first wall section 44, a sloped section 42, and a vertical surface 40.

With reference now to FIG. 1, the actuator 50 includes a wall section 60 having two side arms 52 which extend from the wall 60 which flank the housing sidewalls 38. The sidewalls 52 have channels 56 extending from an inner wall 53 which cooperate with guide ribs 28 of the housing 4. The cooperation of the channels 56 and the guide ribs 28, provides for vertical movement of the actuator, the need for which, will be described herein.

With reference to FIG. 4, the actuator 50 includes an inner surface 66, which cooperates with the surface 44 of the housing; and surface 62 which cooperates with surface 40 of the housing 4. The actuator further includes an inner sloped surface 64 which is spaced from surface 42 of the housing, which allows, iva the channels 56 and guide ribs 28, for vertical movement of the actuator, to the extent provided between the surfaces 42 and 64.

Figure 6:
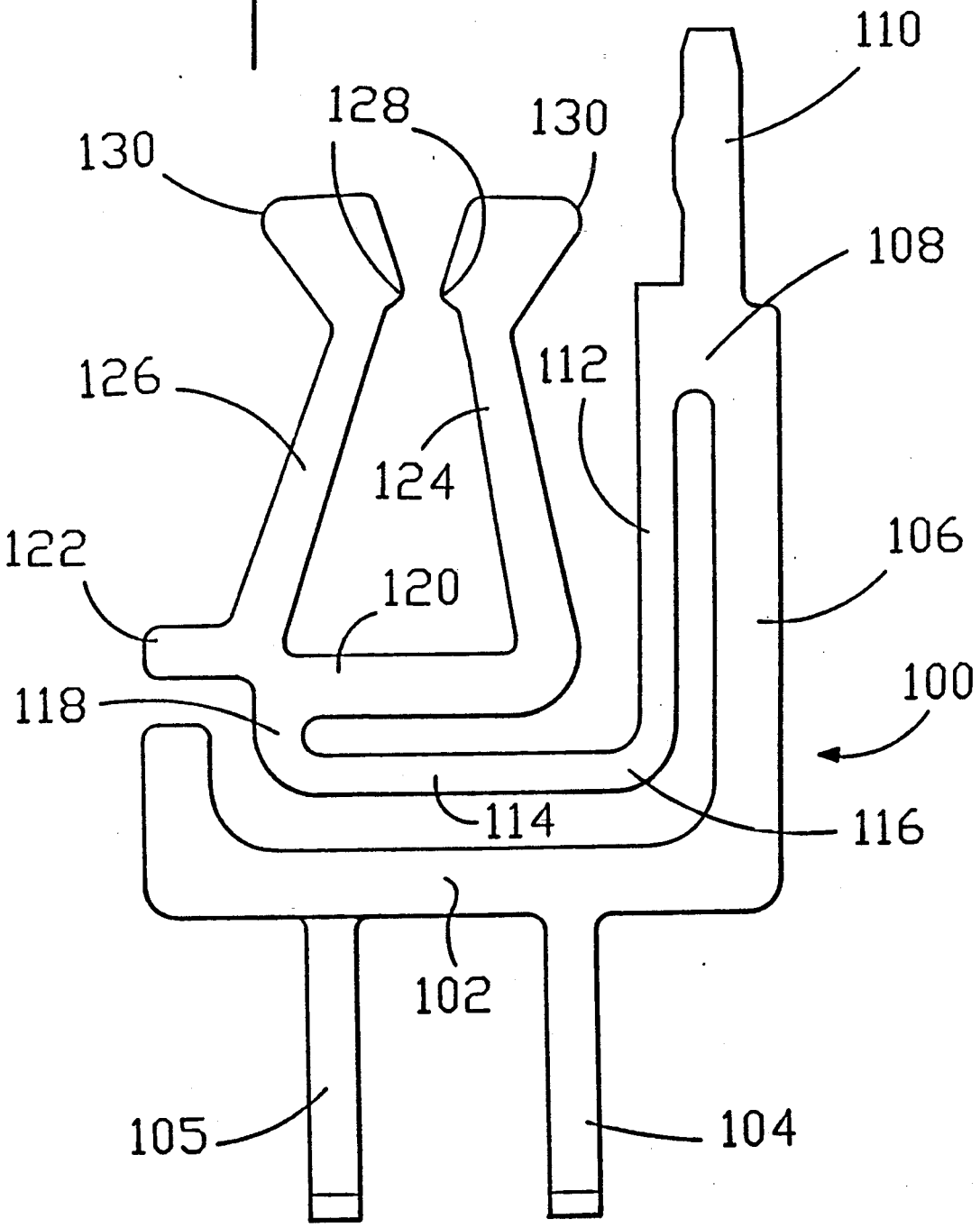
FIG. 6 is a plan view of the electrical terminal.

With reference to FIG. 6, the electrical terminals 100 each include a base portion 102 having a printed circuit board connecting leg 104 or 105, extending therefrom. The terminal then includes a vertical portion 106 which extends upwardly to a junction section 108. At the junction section 108, a retention member 110 is press fit into the aperture 26, which retentively retains the terminals within respective apertures within the edge of the portion 106 against the inside wall 32. Also at the junction section 108, a spring member 112 extends vertically downward, in a parallel fashion with the member 106. The spring member 11 is continuous with a further spring member 114 which extends horizontally or perpendicular to the spring member 112. The spring portion 114 then contains, at its end, a radiused portion 118, which is continuous with a terminal section 120, which itself, contains at its ends, two contact spring arms 124 and 126. The contact arms 124 and 126 have, at their inner and upper edge, two opposed contact portions 128. The contact arms 124 and 126, further include at their outer and upper edges, two sliding edges 130 which cooperate along the sloped inner surfaces 22 and 23 of the housing. The terminals 122 further include an actuator arm 122 extending from the terminal section 120.

To assemble the connector of the instant invention, the terminals are inserted into the lower section of the housing such that the terminal retention portions 110 are aligned with the apertures 26 within the housing. When the fully assembled position as shown in FIG. 4, the sliding portions 130 are slightly engaging the sloped surfaces 22 and 23. The actuator member 50 is also installed over the housing portion 4 such that the channels 56 are placed around the guide ribs 28.

With the connector so assembled, the connector assembly functions as a zero insertion force connector, or ZIF connector, as it is commonly called. When it is desired to interconnect a flexible flat cable, such as 150, to the traces on a printed circuit board, the connector is placed in registry with the printed circuit board (not shown) such that the alternate contact portions 104, 105 are in juxtaposition with through holes of similar pattern on the printed circuit board. A cable 150 is then stripped to expose the conductors 152 of the cable 150. The cable 150 may then be urged towards the connector 2, such that the conductors are aligned the plurality of openings 10 of the connector. It should be understood that the connector assembly may be provided with any convenient number of wire receiving openings 10, such that the number of openings 10, corresponds to the number of conductors in the cable.

When the conductors 152 are within the wire receiving openings 10 within the larger bore 12, further insertion of the conductors 152, aligns the conductors with the opposed contact portions 128, via the tapered section 14. The actuator 50 may now be depressed, to move the actuator vertically downward. The actuator 50 can be moved to the extent provided by cooperating surfaces 42, 64. This downward movement of the actuator 50, caused the lower edge 61 to contact the arm 122, and to cause a downward movement of the horizontal spring portions 120 and 114. It should be understood that when in the steady state condition of the connector shown in FIG. 4, that the spring portion 114 is spring loaded, such that the contact portions 128 are moved towards each other, that is, relative to the stamped dimension of the contact portions 128. Therefore, when the actuator 50 is moved downwardly, the sliding sections 130 of the terminals follow the sloped sections 22 and 23, and thereby open to an extent to accept the wire in a noncontacting arrangement, or zero insertion force. When the wire is fully inserted, the actuator 50 is released which allows the terminals to resume their new steady state condition when the contact portions 128 are in contact with the conductors 152.

Conveniently, this connector design also provides for an increased pull out or extraction force. When the cable 150 is fully inserted to the position shown in FIG. 6, if the cable 150 encounters a tensile force upwards, the tensile force urges the terminal arms 124, 126 and the horizontal section 120 upwards, which caused the sliding sections 130 to ride up the sloped surfaces 22, 23 and to further "bite" into the conductor 152.

I claim:

1. An electrical connector for the electrical connection between a first conductor, to a second conductor, the connector having an insulating housing (4) having a first conductor receiving face (8) with at least one opening (10) profiled for receipt of a first conductor, the opening (10) being in communication with a terminal receiving cavity (18), the terminal receiving cavity (18) having at an upper location, surfaces (22, 23) which are sloped outwardly, and at least one electrical terminal (100) disposed in the terminal receiving cavity (18), the terminal (100) having two contact arms (124, 126) extending upwardly from a base section (120), the electrical connector being characterized in that: the base section (120) is spring loaded upwardly under influence of a spring means (112, 114), the spring means (112, 114) causing the two contact arms (124, 126) to be in engagement with the sloped surfaces (22, 23), the spring loaded base section (102) being moveable relative to the terminal receiving cavity (18), from an upward wire engagement position, to a lower wire receiving position, and in that an actuator (50) is operatively connected to the terminal (100), which when actuated moves the terminal (100) from a first to a second position.

2. The connector of claim 1, further characterized in that each terminal comprises an outwardly projecting actuator arm (122) which extends from the base section (120).

3. The connector of claim 2, further characterized in that the actuator (50) comprises a plate (54) section disposed above the actuator arm (122), whereby movement of the actuator (50) causes a contact between the actuator (50) and the actuator arm (122) thereby causing movement of the terminal (100) from the first to the second position.

4. An electrical connector for the electrical connection between a first conductor and a second conductor, the connector having an insulating housing (4) having a first conductor receiving face (8) with at least one opening (10) profiled for the receipt of a first conductor, the opening (10) being in communication with a terminal receiving cavity (18), the terminal receiving capacity (18) having at least one electrical terminal (100) disposed therein, the terminal (100) having two contact arms (124, 126) extending upwardly from a base section (120) forming opposed contact sections (128), the electrical connector being characterized in that: the terminal receiving cavity (18) has opposing sloped surfaces (22) converging inwardly as said surfaces approach said first conductor receiving face (8), and said base section (120) is spring loaded upwardly under influence of a spring means (112, 114), causing outer edges (130) of said two contact arms (124, 126) to be in spring loaded engagement against said sloped surfaces (22, 23), spring loading said contact arms (124, 126) inwardly, said spring loaded base section (102) being moveable downwardly, away from said first conductor receiving face (8), and said outer edges of said opposed contact portions being movable along said sloped surfaces to move said contact arms from an upper wire engagement position, to a lower wire receiving position.

5. The connector of claim 4, further characterized in that an actuator (50) is operatively connected to the terminal (100), said actuator being adapted for displacing said terminals from said first to said second position upon actuation thereof.

6. The connector of claim 5, further characterized in that each terminal comprises an outwardly projecting actuator arm (122) extending from said base section (120).

7. The connector of claim 6, further characterized in that said actuator (50) comprises a plate section (54) disposed above said actuator arm (122), whereby movement of said actuator causes said actuator (50) to contact said actuator arm (122) thereby causing movement of said terminal (100) between said upper to said lower position.

8. An electrical connector comprising:

an insulative housing having a first conductor receiving face having conductor receiving means extending through said face, said housing having a plurality of terminal receiving passageways communicating with said conductor receiving means, said terminal receiving passageways including stationary upper ramped edges converging upwardly and inwardly towards said conductor receiving means, said housing further comprising a mounting face; and a plurality of electrical terminals positioned in said terminal receiving passageways, said terminals comprising spring arm means interconnected to two contact arms, said contact arms comprising free ends having outer edges and inner edges forming opposed contact surfaces, said spring arm means resiliently biasing said contact arms towards said conductor receiving means, with said outer edges of said contact arms in engagement against said upper ramped edges, thereby moving said opposed contact surfaces towards each other;

said spring arm means being adapted to allow movement of said spring arm means towards and away from said first conductor receiving face, such that when said spring arm means is moved downwardly, said contact arms are moved downwardly with said outer edges of said contact arms adapted to engagingly follow said upper ramped edges, such that said opposed contact surfaces are opened for the insertion of conductors therebetween.

9. The connector of claim 8, wherein said terminals further comprise conductor connecting sections disposed adjacent to said mating face.

10. The connector of claim 9, wherein said conductor connecting sections are profiled for interconnection to a printed circuit board.

11. The connector of claim 8, wherein said terminals further comprise an actuator arm disposed adjacent to said spring arm means.

12. The connector of claim 11, wherein said connector further comprises an actuator member positioned, at least partially around said insulative housing, and slidably movable relative to said insulative housing, said actuator member comprising means to contact said actuator arms of said terminals upon said movement.

13. The connector of claim 12, wherein said actuator arms of said terminals extend through an opening of said housing, and said actuator contact means comprises a lower edge of said actuator member.

14. The connector of claim 8, wherein each said terminal comprises a base portion and an upstanding leg, and said spring arm means comprise first and second spring members extending from said upstanding leg.

15. The connector of claim 14, wherein said first spring member is substantially parallel to said upstanding leg, and said second spring member is substantially parallel to said base portion.

16. The connector of claim 15, wherein said contact arms extend from said second spring member.

* * * * *